US007753420B2

(12) United States Patent
Beavin

(10) Patent No.: US 7,753,420 B2
(45) **Date of Patent: *Jul. 13, 2010**

(54) COLLECTING APPARATUS WITH SEAT

(76) Inventor: Jeff Beavin, 4056 Wetherburn La., Suite 200, Norcross, GA (US) 30092

( * ) Notice: Subject to any disclaimer, the term of this patent is extended or adjusted under 35 U.S.C. 154(b) by 132 days.

This patent is subject to a terminal disclaimer.

(21) Appl. No.: 12/108,211

(22) Filed: Apr. 23, 2008

(65) Prior Publication Data

US 2009/0020441 A1 Jan. 22, 2009

Related U.S. Application Data

(63) Continuation-in-part of application No. 11/778,689, filed on Jul. 17, 2007, now Pat. No. 7,377,565.

(51) Int. Cl.
*A63B 47/02* (2006.01)
*A47C 13/00* (2006.01)

(52) U.S. Cl. ..... 294/19.2; 297/129

(58) Field of Classification Search ..... 294/19.2; 206/315.9; 473/460; 56/328.1; 297/129, 297/118.08, 188.08
See application file for complete search history.

(56) References Cited

U.S. PATENT DOCUMENTS

| | | | | | |
|---|---|---|---|---|---|
| 698,226 | A | | 4/1902 | Roberts | |
| 771,886 | A | | 10/1904 | Smith | |
| 2,800,953 | A | * | 7/1957 | Goehler et al. | 280/47.19 |
| 2,810,252 | A | * | 10/1957 | Kelly | 56/328.1 |
| 3,258,286 | A | * | 6/1966 | Coward | 294/19.2 |
| 3,889,996 | A | | 6/1975 | Campbell | |
| 3,926,465 | A | | 12/1975 | Hoagland et al. | |
| 3,982,781 | A | * | 9/1976 | Tucker et al. | 294/19.2 |
| 4,184,707 | A | | 1/1980 | Nelson et al. | |
| 4,412,697 | A | | 11/1983 | Verde | |
| 4,460,188 | A | * | 7/1984 | Maloof | 280/30 |
| 4,811,980 | A | | 3/1989 | Ferrari et al. | |
| 5,301,991 | A | | 4/1994 | Chen et al. | |
| 5,951,075 | A | | 9/1999 | Green | |

(Continued)

FOREIGN PATENT DOCUMENTS

| | | |
|---|---|---|
| BE | 1009774 A6 | 8/1997 |

(Continued)

*Primary Examiner*—Dean J Kramer
(74) *Attorney, Agent, or Firm*—Williamson Intellectual Property Law, LLC; Thomas R. Williamson, III

(57) ABSTRACT

A collecting apparatus having a seat, and method of use thereof, wherein the collecting apparatus comprises a plurality of selectively positionable elastic members secured to a plurality of securing points on a lower portion of a frame or a removable base section connected to the frame. The elastic members are secured to user-selected securing points so that the distance between the elastic members can accommodate objects of different sizes. The collecting apparatus is pressed on top of a ball or similar object, causing the elastic members to separate and allow the ball or similar object to enter and be retained within the frame. Upon entering of the object within the frame, the elastic members retract to their original position, therein preventing the object from falling back out. Objects can be retrieved by lifting the seat or reaching through an aperture formed by a seat opening and a frame front opening.

14 Claims, 12 Drawing Sheets

U.S. PATENT DOCUMENTS

| | | | | |
|---|---|---|---|---|
| 6,142,544 | A | 11/2000 | Benzoni et al. | |
| 6,302,460 | B1 | 10/2001 | Carr | |
| 6,340,188 | B1 * | 1/2002 | Cuti | 294/19.2 |
| 6,412,839 | B1 | 7/2002 | Tran | |
| 6,422,621 | B1 | 7/2002 | Tandlich | |
| 6,481,768 | B1 | 11/2002 | Fu | |
| 6,510,861 | B1 * | 1/2003 | Mead | 135/16 |
| 6,945,578 | B2 | 9/2005 | Hellerson | |
| 7,377,565 | B1 * | 5/2008 | Beavin | 294/19.2 |
| 2004/0227365 | A1 | 11/2004 | Hellerson | |

FOREIGN PATENT DOCUMENTS

| | | | |
|---|---|---|---|
| CN | 2666503 | Y | 12/2004 |
| DE | 3144898 | A1 | 5/1983 |
| DE | 3826923 | A1 | 2/1990 |
| DE | 4323412 | A1 | 1/1994 |
| FR | 2819421 | A1 | 7/2002 |
| FR | 2838354 | A1 | 10/2003 |
| GB | 469482 | | 7/1937 |
| JP | 2005-152568 | | 6/2005 |

* cited by examiner

COLLECTING APPARATUS WITH SEAT

CROSS-REFERENCE TO RELATED APPLICATIONS

The present application is a continuation-in-part application to non-provisional patent application Ser. No. 11/778,689, entitled "BALL COLLECTING APPARATUS AND METHOD OF USE THEREOF", filed on Jul. 17, 2007 now U.S. Pat. No. 7,377,565, and claims priority thereto and the full benefit thereof.

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

1. Technical Field of the Invention

The present invention relates to an object collecting apparatus having a seat incorporated therein, more particularly to an apparatus with elastic members which may be secured in user-selected positions to accommodate different size objects.

2. Description of Related Art

There are various types of object collecting devices, such as, without limitation, fruit/nut collectors, ball collectors or ball hoppers. In addition to collecting sporting balls or fruits/nuts, there is a further need for a collector that can be varied to pick up objects that are other than generally spherical.

Particularly, diverse articles of manufacture, such as, for exemplary purposes only, electric motors, liquid containers, batteries, and other such objects that are usually picked up by hand, are often found on manufacturing facility floors after having been removed or fallen from a production line.

Such diverse articles of manufacture typically require a worker to bend over and pick up the stray object, thereby causing repeated physical stresses and strains on the worker. Further, previous devices are typically sized to pick up only a particular object and additional devices must be obtained in order to retrieve a different sized or shaped object.

Various golf ball and nut gathering devices exist that utilize springs or spring wires at the base thereof, wherein the golf ball or nut passes through the springs/spring wires into a containment section. However, such devices are sized for a given purpose and are not adjustable to accommodate different size objects without modification.

One previous device for picking up spherical material discloses utilizing several elastic bodies stretched on a frame body part to form an opening part a little smaller than the outline of the spherical material, such as a ball, so that the spherical material expands the elastic bodies to loosely insert the spherical material from the opening part into the frame body. However, this device is limited in the size spherical objects it would be able to retrieve by the natural expansion of the elastic bodies and is lacking of readily adjustable elastic members to selectively change the size of the object to be accommodated. Accordingly, such a device would not be suitable for picking up fruits/nuts, diverse articles of manufacture or assorted sporting balls.

Another device discloses a system to gather table tennis balls which has a tube acting as a sleeve, with a large cylinder at its lower end having a mesh base. The mesh cords pass through holes at the lower end of the large cylinder with a gap of approximately 35 mm between the mesh cords, which are at a low tension.

Another device discloses a frame for picking up table tennis balls with a grid of parallel elastic cords stretched across it and fitted with a handle; however, the elastic cords are not readily adjustable and thus the device cannot truly accommodate substantially different size balls or other objects.

Yet another device discloses an apparatus to assist in retrieving balls and in storing balls, such as tennis balls. The apparatus comprises a bottom frame through which a ball may pass upwardly when the bottom frame is positioned over the ball and pressed firmly to the ground wherein the frame prevents the ball passing downwardly and out of the frame. The ball is retained by a member, wherein the member moves through springs attached to the frame; however, the device lacks a readily adjustable member to accommodate substantially different size balls.

Still another device discloses an apparatus for picking up balls, especially tennis balls, with a ball collection basket which has a ball inlet device in its base. The ball inlet device possesses longitudinal parts extending between two opposing lateral walls of the ball collection basket and arranged at least approximately parallel to each other and at a distance from each other and/or from the lateral walls lying at least approximately parallel thereto, this distance being slightly less than the diameter of a ball to be received. Collection or release frames, which are pivotable about a horizontal axis, are attached to the ball collection basket. The longitudinal parts are resilient; however, the device lacks readily adjustable longitudinal parts to accommodate substantially different size balls.

Another device discloses a device for retrieving table tennis or golf balls which comprises a frame with rectangular, polygonal or circular ends, between which are stretched elastic cords; however, the device lacks readily adjustable elastic cords to accommodate substantially different size balls.

Yet another device discloses a ball collector for picking up balls of different diameters. Springs or some other elastic material are stretched between two discs, as near as possible to the outside edge, in such a fashion that they run parallel to each other but are not horizontal to the ground, instead running from one disc to the other at a given angle. Additionally, a bracket with a long handle is fixed above the whole assembly to the outsides of the discs, which also function as wheels, so that the whole thing can be pushed along. When the device rolls over a ball, the springs or similar will move apart somewhat as they are pushed up and will cause the ball to end up in the reservoir on the inside. However, the device lacks readily adjustable springs or some other elastic material to accommodate substantially different size balls.

Still another device discloses an apparatus for picking up, transporting and storing balls which comprises two opposing planes separated by tension elements which when forced over a solid, hollow or pressurized sphere simultaneously stretches the tension elements and/or compresses the sphere sufficiently to permit the sphere entry between the planes. Once the sphere is between the planes it is kept in place by the forces created by the stretched tension trying to regain their original unstretched configuration and the pinched sphere trying to regain its original configuration by trying to expand out.

Another device discloses a ball retrieval and storage device for retrieving balls of at least two different sizes comprising a wheeled container with rotatably attached handled. The container is rollingly supported by two wheels on an axle, and includes a removable rack which, when in place, covers the container to ensure the contents remain within the container. When the removable rack is placed beneath the container, the entire device is elevated to prevent needless bending and stooping by the user. The device further comprises a retrieval opening which includes a fixed member and a movable member to provide variable spacing between them depending on the size ball to be retrieved. The device is placed near a ball to be retrieved, tilted backward onto its wheels, rolled forward such that the ball is beneath the opening, then returned to its upright position in order to capture a ball. The angular movement of the movable member in a direction generally upwardly and away from the fixed member allows for differing sized balls to be retrieved and stored. A resilient member retracts the movable member back to its original position following capturing of a ball.

Yet another device discloses a container for the delivery, transportation, dispensing and collection of plastic tennis balls, which container is substantially characterized by the removal of the base, except for an inward-facing flanged edge and the arrangement of longitudinally-orientated, spaced, calibrated sprung steel bars. The tennis balls are pushed in through the free gaps between the bars and their emergence at the bottom is blocked. Moreover, folding handle strands are provided which are effective either upwards as a carrying facility or collection position or downwards in the folded-down position as supporting feet.

Still another device discloses a ball retrieving and storage device which includes a container having an elongated handle extending above it, and one or more movable gate members in the bottom of the container. Balls are retrieved from the ground by placing the bottom of the container over the balls and exerting a downward force on the handle to force the balls up against the bottom of the movable gate member which opens the gate and provides an enlarged opening in the bottom of the container for allowing each ball to pass into the container. Continued downward movement causes the moving gate member to engage stop bars on opposite sides of the container for limiting further vertical movement of the gate sufficiently to allow the equator of each ball to pass through the enlarged opening and then allow the gate to automatically drop to a closed position to retain balls in the container. A cylindrical-shaped cage also is disclosed which provides a rotary type ball retriever adapted to be rolled on the ground to engage balls which automatically open gate members spaced around the outer circumference of the cage.

Another device discloses a ball retrieving and storage cart which generally comprises a wheeled carriage that rollingly supports a basket in a ball retrieving position. In an exemplary embodiment, the basket has a front end and a rear end and includes a bottom wall having two side members oriented front to rear and having a normal position spaced apart less than the ball diameter and defining a slotted aperture for entrance of a ball into the basket. In the ball retrieval position, at least one of the side members is a slanted member having a front end higher from the ground than a ball radius and a rear end lower to the ground than the ball radius. At least one of the side members is a deflectable member and is biased to the normal position but is sideways deflectable such that a ball on the ground entering the aperture sideways deflects the deflectable member sufficiently for the ball to pass into the basket. The wheels may define a rolling plane. The carriage includes a vertical frame member terminating in a push handle and the vertical frame member includes brackets for attaching a moveable basket at a serving position that is higher than the ball retrieving position.

Yet another device discloses a ball retrieval and storage device which includes a container having a hollow interior for storing a substantial number of tennis balls. At least a portion of the container bottom is formed by one or more movable rod members which are movable to allow the balls to enter through the bottom of the container. A user can retrieve a ball lying on the ground by forcing the bottom of the container down over the top of the ball. The ball engages the movable rod member and moves it slightly upwardly which allows the ball to enter the container as the container is progressively forced down over the top of the ball compressing the ball. The movable rod members are formed of a material having an elastic memory such that for use over time, the movable rod members will not permanently deform so as to decrease the efficacy of the ball retrieval and storage device.

Still another device discloses a ball retrieving and storage device including a storage container having a pair of handles hingedly fixed thereto which may be folded to a downwardly extending position supporting the container on a playing surface. The retrieving device includes a plurality of parallel rods extending across the bottom of the container. The rods are spaced apart from one another a distance greater than the diameter of the balls to be retrieved and being slightly resilient in a direction perpendicular thereto. Each of the rods has journaled thereon a hollow, cylindrical tubular roller to provide for a rotating movement, wherein the distance between inside surfaces of adjacent parallel rollers is slightly less than the diameter of a used tennis ball. The transverse resilience of the rods and the rotating motion of the rollers permit a ball to be retrieved by forcing the bottom of the container down over the ball. When folded upwardly the handles of the container enable an operator to both carry and retrieve balls from a playing surface without bending or stooping. When a substantial number of balls are held within the container, the handles may be folded into a downwardly extending position to support the container at a convenient height for the removal of balls.

Another device discloses a ball-picking device which is utilized to pick up a ball on a ground surface, and includes a basket frame unit which confines a ball receiving space and which has a ground contacting side formed with a plurality of ball-extension gaps that are in spatial communication with the ball receiving space. Each of the ball-extension gaps is confined by a pair of deformable, yet not elastic, rod units, and is slightly narrower than a diameter of the ball such that when the ground contacting side of the basket frame unit is moved toward the ground surface to register the ball with one of the ball-extension gaps, the deformable rod units that define a respective one of the ball-extension gaps will be pushed apart and will be deformed by the ball so as to enlarge the respective ball-extension gap and permit extension of the ball into the ball receiving space. However, the device lacks readily adjustable deformable rod units to accommodate substantially different size balls.

Yet another device discloses a sports ball retrieval and storage device which includes a receptacle, a pair of support members and a lid. The receptacle is in the form of a molded one-piece body made of substantially rigid material and having a plurality of side walls and a bottom grate integrally connected together so as to define an open top and an interior chamber of the receptacle. The side walls and bottom grate are formed of respective upper and lower annular perimeter members and laterally spaced-apart elongated members extending between and integrally connected at opposite ends with opposite portions of the upper and lower annular perimeter members. The side walls converge toward one another from the open top to the bottom grate of the receptacle and thereby provide the molded one-piece body of the receptacle with a tapered configuration permitting receptacles of multiple devices to nest with one another. The elongated members of the bottom grate are spaced apart at a distance slightly less than the diameter of a tennis ball so as to define at least one opening therebetween through which a compressed tennis ball can be forced into the interior chamber. The support members are pivotally mounted to the receptacle and convertible relative thereto between stand and handle positions. The lid is mounted to the receptacle for opening and closing the open top thereof.

Still another device discloses a tennis ball collector with drum cage, wherein the drum's peripheral surface has axially parallel bars between its end flanges which are in the form of discs or tires. The U-shaped handle has sides each of which has an angled part which, together with the middle of the U-shaped handle, forms a U-shaped stand. Wheels are attached to the angled parts which have a profiled grip surface.

Another device discloses a collapsible ball retriever and storage unit which is in the form of a receptacle composed of a plurality of side grills pivotally hinged one to the next, and a top gate and a bottom grate being pivotally hinged to respective ones of the side grills. The side grills are pivotable relative to one another to convert them between erected and collapsed positions, whereas the top gate and bottom grate are pivotable relative to the side grills to convert the top gate and bottom grate between closed and retracted opened positions. The gate and grate are latchable to others of the side grills disposed opposite to the ones thereof to which the gate and grate are respectively hinged. The bottom grate is adapted to rigidly retain the side grills in their erected position when the bottom grate is disposed in the closed position. Further, the bottom grate has members defining ball passages therethrough which adapts the receptacle for retrieving and storing balls when the side grills are in the erected position and the bottom grate is in the closed position.

Yet another device discloses a tennis ball retriever includes a cylindrical collection drum having circular cylinder bases spaced from one another. The cylindrical collection drum has openings formed in a peripheral cylinder region such that balls can be pushed therethrough. The circular cylinder bases have sleeves extending along the cylinder axis. A removable handle includes two arms extending away from the cylinder axis. The arms have stub axles at their ends such that the stub axles extend along the cylinder axis and are rotatably journaled in the sleeves. The removable handle is resiliently deformable for moving the stub axles away from the sleeves so that the cylindrical collection drum can be removed from the handle. A ball retrieving and storing system is also provided. The ball retrieving and storing system includes at least two cylindrical collection drums and a removable handle.

Still another device discloses a tennis ball retriever and storage unit includes a ball retrieving receptacle supported by spring biased pivoting wheel assemblies for rolling movement between locations for retrieving used tennis balls and downwardly movement from a normal upper transport position overlying a tennis ball to a lower position for retrieving the tennis ball between spaced rigid bars in the base of the receptacle.

Due to the constraints of current devices for picking up balls, one typically must buy a different type of ball collector for each type of ball. Although some devices claim to pick up different types and shapes of spherical objects, upon closer evaluation it can be seen that the devices are designed to pick up an object of one size, but the devices themselves may be manufactured to different sizes, enabling a plurality of devices to pick up different size objects.

Thus, currently existing devices fail to adjust to accommodate different size spherical objects and multiple devices must be purchased to pick up and store different size objects and further lack the ready ability to be switched from a standing device to a transporting device. Lastly, previous devices lack the inclusion of a seating mechanism.

Therefore, it is readily apparent that there is a need for a collecting apparatus and method of use thereof which minimizes and/or overcomes these deficiencies by providing a collector that is adjustable to user selected points to pick up, retrieve, and store objects of different diameters and/or shapes. This would serve the functions of reducing cost, time, inefficiencies and multiplicity of machines while providing maximum customer satisfaction through a single collector. In particular, there is a need for a device that obviates repetitive bending over, thereby preventing stresses, discomfort and/or damage to the user's back. Further, there is a need for a device that is portable for moving collected objects to another location and which provides a surface for seating of a user during operation.

SUMMARY OF THE INVENTION

Briefly described, in a preferred embodiment, the present invention overcomes the above-mentioned disadvantages and meets the recognized need for such a device by providing an object collecting apparatus with seat, and method of use thereof, which is capable of being adjusted to retrieve and accommodate different size objects.

More specifically, the collecting apparatus is an apparatus for picking up multiple objects off of the ground or similar surface and storing them in a transportable container that has a seat thereon. The container has hingable supports that in the downward position provide supporting legs and in the upward position form a carrying handle. The collecting apparatus comprises a frame and a plurality of elastic members which are removably secured to a lower portion of the frame. The plurality of elastic members can be secured at different points, creating different size spacing between the elastic members and/or the frame. When the apparatus is pressed on top of an object, particularly a non-deformable object, the elastic members expand to slightly wider than the width of the object, allowing the object to enter the framed collection area. Once the equator of the object is passed, the tension in the plurality of elastic members returns the members to their original shape and prevents the object from falling out of the collection area defined by the frame. Thus, the collecting apparatus as disclosed is capable of adjusting to selectively pick up different size objects. Having such an apparatus eliminates the need to purchase multiple collectors to pick up different size objects.

When standing up on its legs/handles, the seat portion can be utilized as a table (when in the down position) or opened for more ready access to the contents of the container for retrieving same. When placed on a surface such as a ground surface, the legs/handles, which may also be telescopic, extend sideways to proved stability. In such position, a user can readily sit on the seat and extend their hand into the container via a cutout section of the seat and a complementary corresponding opening in the side of the container front wall.

According to its major aspects and broadly stated, the present invention in a preferred embodiment is an object collecting apparatus having a seat and a containment frame. The collecting apparatus has left and right legs for support and/or transport (as handles) and elastic bungees at the bottom of the containment frame to permit entry of objects to be retrieved. The containment frame has an interior, hinges and clips. The seat has a front, hinges, an opening and notches, wherein the hinges permit the seat to be raised to facilitate access to the interior of the containment frame to retrieve objects therewithin.

The legs are secured to the containment frame via hinges and are secured to the containment frame in up or down position by clips. When upward, the legs also are received in notches of the seat to provide a more rigid structure.

In use, the collecting apparatus can selectively be stood upright on the ground, with legs fully downward. A user retrieves objects by reaching into the interior of the containment frame through the seat opening and a front opening in the containment frame, which together cooperatively form an aperture dimensioned to permit extraction of objects from within container. Alternately, the user lifts the seat to provide easier access to interior of the containment frame. When standing with the seat down, objects can be placed on the seat for easy access, such as a score card and/or pen.

To collect and/or transport objects, the legs are hinged upward and held by handles formed by the legs. The user grasps the collecting apparatus by the handles and places the collecting apparatus over an object, pressing the collecting apparatus down, forcing the object through the bungees into the interior of the containment frame. Once retrieved, the objects can be transported by the user.

When it is desired to utilize the collecting apparatus as a sitting surface, the legs are hinged sideways and the containment frame is placed on a surface, such as, for exemplary purposes only, a flat, horizontal surface. The user then sits on the seat and retrieves objects from within the containment frame by reaching into the containment frame through the aperture formed by the seat opening and the front opening. Alternately, the seat can be lifted to provide ready access to the interior of the containment frame. The legs provide stability to the collecting apparatus when the legs are positioned sideways. The legs can further be shortened by telescoping within telescopic sections thereof.

The collecting apparatus can also be utilized to collect a variety of manufacturing objects, such as, for exemplary purposes only, electric motors or bottles from a factory floor.

In another embodiment, the collecting apparatus further comprises at least one handle portion disposed on the frame. The handle is rigid and of sufficient length to allow a user to press down on the handle thereby pressing down on the frame of the collecting apparatus so that an object is forced into the container without requiring the user to bend over. In a further embodiment, the handle is of sufficient length and shape to be folded down to form a stand for the collecting apparatus. The handle thus eases the use of the collecting apparatus and minimizes the amount of bending down required by the user. Further, having the handle fold down for use as a stand allows a user to set up the collecting apparatus at a height off of the ground suitable for easy access to the objects without the user bending over.

In an alternate embodiment, the object collecting apparatus comprises a frame having a lower portion, an upper portion and at least one rigid connector joining the lower portion and the upper portion, and a plurality of elastic members disposed on the lower portion of the frame. The plurality of elastic members further comprises a first end and a second end that are securable to selectable points of the lower portion of the frame. Thus, a user can adjust the spacing between the plurality of elastic members and/or the frame via selection of the points where the plurality of elastic members are secured on the lower portion of the frame. This allows a single apparatus to be utilized to pick up different size objects.

In a further alternate embodiment, the elastic members are adjustable in length. Elastic objects have a tendency to lose tension as time progresses, particularly if they are left in a tensioned state. Allowing the plurality of elastic members to be adjustable in length ensures adequate tension is always maintained and that the collecting apparatus will continue to function as intended.

In still a further alternate embodiment, the collecting apparatus further comprises a pocket for storing the plurality of elastic members. Due to the nature of the apparatus, not all of the elastic members must be utilized at the same time. Thus, it is beneficial to a user to provide a pocket or storage pouch secured to the apparatus for storing the plurality of elastic members. This prevents loss of the plurality of elastic members and further and allows them to be stored when not in use, thereby reducing the stretching and subsequent deterioration of the plurality of elastic members.

In yet a further alternate embodiment, the lower portion of the frame and the first end of the plurality of elastic members comprise cooperative fasteners, such as, for exemplary purposes only, mating snaps, wherein the lower portion of the frame and the second end of plurality of elastic members comprise similar cooperative fasteners.

In yet another alternate embodiment, the plurality of elastic members comprise both mating portions of the snaps, wherein the elastic member is wrapped around the lower portion of the frame and one end backtracks across the lower portion of the frame to secure the elastic member to itself and around the lower portion of the frame. This allows the plurality of elastic members to be secured to the lower portion of the frame at any position and further ensures the plurality of elastic members will remain in a constant state of tension when in use.

In a further alternate embodiment, the lower portion of the frame further comprises a plurality of apertures for securing the first end of the plurality of elastic members and for securing the second end of the plurality of elastic members. With a plurality of apertures on the lower portion of the frame, the plurality of elastic members are secured to the frame by inserting hooks and/or another securing device into the plurality of apertures. Thus, the elastic members are secured in any position where there is an aperture on the lower portion of the frame, differentiating the space between the elastic members to accommodate different size objects.

In yet another alternate embodiment, the first end of the plurality of elastic members further comprises a mechanism for securing the first end of the plurality of elastic members to the frame. Additionally, the second ends of the plurality of elastic members comprise a securing mechanism, thereby allowing for the complete removal of the plurality of elastic members and selectable and/or adjustable placement of the plurality of elastic members. In one alternate embodiment, the securing mechanism disposed on the plurality of elastic members is a hook, while in another alternate embodiment, the securing mechanism is a loop. The hook is typically secured to an aperture or peg disposed on the lower portion of the frame of the collecting apparatus. A loop-type securing mechanism is secured to a peg or hook on the lower portion of the frame or alternatively may be secured to the lower portion of the frame directly.

In still another alternate embodiment, the lower portion of the frame further comprises a plurality of pegs for securing the first end of the plurality of elastic members and for securing the second end of the plurality of elastic members. Thus the plurality of elastic members are secured to the lower portion of the frame in any position where a peg exists. In a further alternate embodiment, the pegs are removably secured to the lower portion of the frame. Removal of the pegs from the lower frame allows the pegs to be replaced in case of accidental breakage. Additionally, it allow for unused pegs to be removed from the ball collecting apparatus when they are not in use. In a further alternate embodiment, the pegs have an aperture for securing the plurality of elastic members. If the plurality of elastic members selectively have hooks for securing to the pegs disposed on the lower portion of the frame, it is advantageous to have apertures within the pegs to prevent slippage and/or accidental removal of the plurality of elastic members. In an additional alternate embodiment, the plurality of pegs have a lower portion secured to the lower portion of the frame and an upper portion, wherein the upper portion has a securing flange, for exemplary purposes only, and not intended to be limiting, pegs with a securing flange in the shape of an arrow facing up in relation to the lower portion of the frame, a T-shape, mushroom shape, similar shape and/or any combination of the like. One skilled in the art would recognize the securing flange can be any shape or size suitable to prevent slippage and/or accidental removal of the plurality of elastic member; however, pegs with a wider upper portion which extends toward the lower portion of the plurality of pegs is preferred and specifically contemplated without limitation.

In another alternate embodiment, lower portion of the frame further comprises a track and a plurality of adjustable members disposed on the track for securing the first end of the plurality of elastic members and for securing the second end of the plurality of elastic members. In yet another alternate embodiment in which the track and adjustable members are used, the adjustable members are lockable to prevent movement of the plurality of adjustable members. Thus the adjustable members are locked into place to prevent movement of the elastic members while still being adjustable to allow for different placement of the plurality of elastic members so that the collecting apparatus accepts different size objects.

In yet another alternate embodiment, the lower portion of the frame further comprises a plurality of rings for securing the first end of the plurality of elastic members and for securing the second end of the plurality of elastic members. Additionally, the rings are fixedly, yet adjustably, secured to the lower portion of the frame. The plurality of rings, for exemplary purposes only, may be restricted from movement by grooves in the lower portion of the frame. Thus the plurality of elastic members are secured to the rings and the rings are restricted from movement. This allows the collecting apparatus to accept different size objects within the framed collecting area while still providing a quick and easy means to adjust the distance between the plurality of straps and/or the frame.

In use, a method of collecting objects is provided, wherein the method comprises the steps of securing at least one elastic member to a lower portion of a frame in an original position, wherein the original position creates a space between each of the at least one elastic member and the frame that is smaller than a diameter of an object to be picked up, pressing the frame over an object, wherein pressing causes forces to be exerted on the at least one elastic member, and wherein the at least one elastic member moves to a width which allows an object to enter the frame, and subsequently the at least one elastic member returns substantially back to its original position. In this manner, the collecting apparatus can easily and quickly be adjusted to accommodate different size objects which are taken into the framed collection and storage area.

When it is desire to utilize the collecting apparatus as a table, such as, for exemplary purposes only, to support a writing tablet, score card, pen, or the like, the collecting apparatus legs are hinged downward to form a stand. Alternately, when a place to sit is required, the legs are hinged sideways and the container is placed on a flat, generally horizontal, surface, thereby providing a place to sit on the seat of the collecting apparatus.

In an alternate embodiment, the ball collecting apparatus comprises a frame, wherein the frame further comprises a lower portion, an upper portion and at least one connector joining the lower portion and the upper portion, a base removably or releasably secured to the lower portion of the frame, and a plurality of elastic members disposed on the base, wherein the plurality of elastic members further each comprise a first end and a second end, and wherein the first end and the second end are securable to selectable points of the base. In practice, it is often difficult to reach to the bottom of the ball collecting apparatus, particularly if the height of the frame is substantially large. This increases the difficulty in securing the plurality of elastic members to the lower portion of the frame itself. To ease use and efficiency, it is desirable to allow the removal of a base portion so that the base can be accessed easily. Once the base is removed from the frame, the plurality of elastic members are secured to the base by any of the means disclosed herein, without limitation, and/or any other means one skilled in the art would consider appropriate for temporarily securing an elastic member to a rigid frame. Subsequently, the base, which is substantially the same shape and width as the lower portion of the frame, is secured to the frame by any means known to one skilled in the art and the collecting apparatus functions as intended to pick up objects of a size suitable to the distance between the plurality of elastic members and/or the base. In a further embodiment, the elastic members are secured directly between the base and the lower portion of the frame which reduced the number of necessary parts for the collecting apparatus. For instance, either the base or the lower portion of the frame where the base connects may comprise a plurality mating pegs, and the plurality of elastic members are secured on the pegs. The base and the lower portion of the frame are then secured together by inserting the male portions of the pegs, which secure the elastic members, into the female receiving portion on the opposing side of the base or the frame.

In a further alternate embodiment, the lower portion of the frame or the base comprises markings which identify for a user the preferred locations for different types and sizes of objects. Thus, a user does not have to experiment and continuously adjust the plurality of elastic members to find the appropriate size for a specific type of object. One skilled in the art would recognize the collecting apparatus could be utilized to pick up any type of object including, without limitation, beverage bottles, electric motors, and/or various sporting balls, but is particularly suited to non-deformable objects.

Accordingly, a feature and advantage of the present invention is its ability to provide a collecting apparatus which can be adjusted to accommodate different size objects.

Another feature and advantage of the present invention is its ability to allow for the quick and easy adjustment of elastic members to accommodate different size objects.

Still another feature and advantage of the present invention is its ability to allow the removal of a base portion of the collecting apparatus to ease in securing of the plurality of elastic members.

Yet another feature and advantage of the present invention is its ability to ease the burdens and physical stresses of a user by minimizing the amount of bending over to pick up objects.

Yet still another feature and advantage of the present invention is the ability to completely remove the elastic members to minimize and/or prevent over-stretching, loss of tension and deterioration of the plurality of elastic members.

A further feature and advantage of the present invention is its ability to provide a storage area for the plurality of elastic members when they are not in use.

Yet a further feature and advantage of the present invention is its ability to provide a table for placing object at an elevated height.

Still yet a further feature and advantage of the present invention is that it provides a place for a person to sit.

Yet another feature and advantage of the present invention is that it provides access to the contents of the container while in use as a seating apparatus.

These and other features and advantages of the present invention will become more apparent to one skilled in the art from the following description and claims when read in light of the accompanying drawings.

BRIEF DESCRIPTION OF THE SEVERAL VIEWS OF THE DRAWINGS

The present invention will be better understood by reading the Detailed Description of the Preferred and Selected Alternate Embodiments with reference to the accompanying drawing figures, in which like reference numerals denote similar structure and refer to the elements throughout, and in which.

DETAILED DESCRIPTION OF THE PREFERRED AND SELECTED ALTERNATE EMBODIMENTS

Figure 1A:
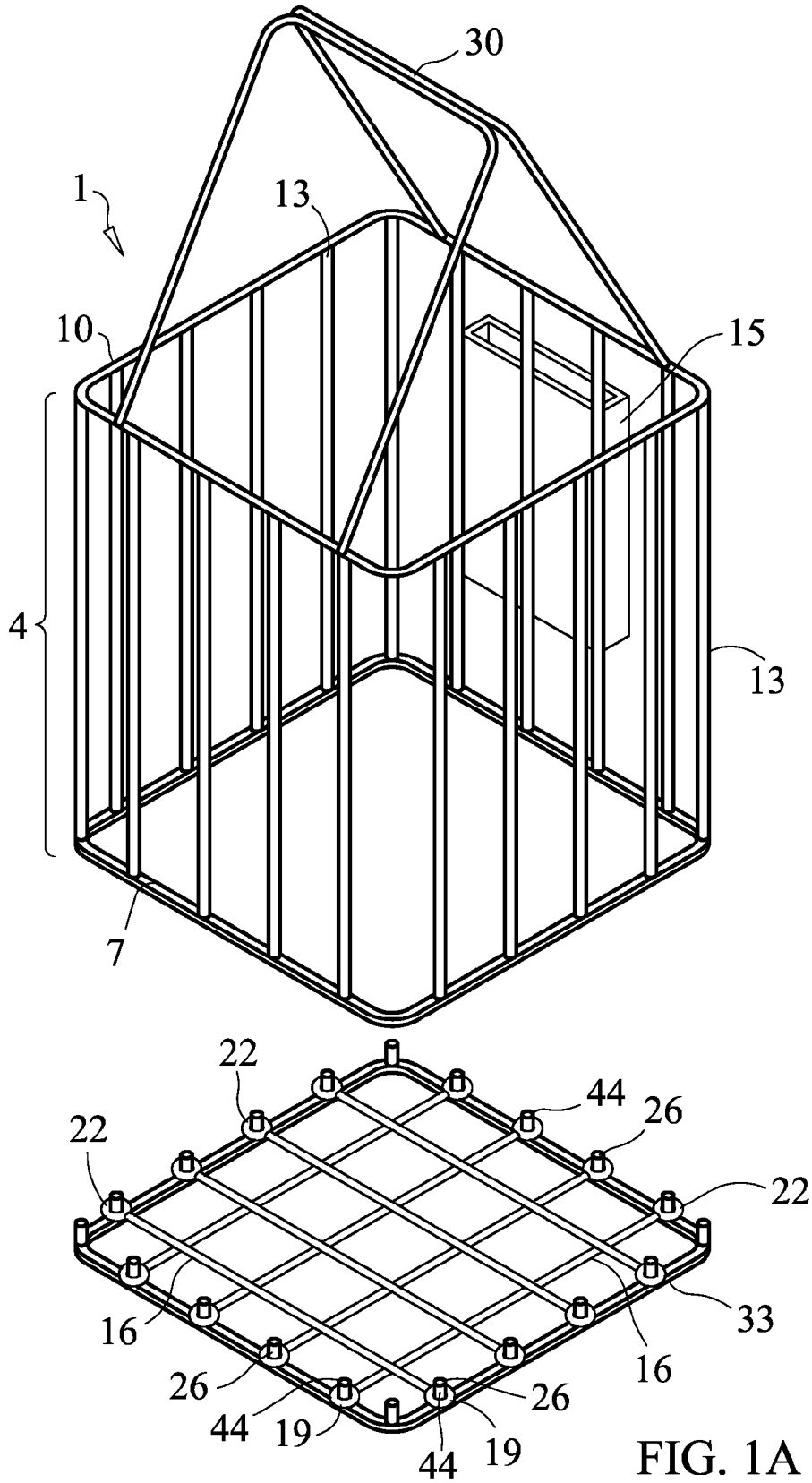
FIG. 1A shows a top perspective view of an alternate embodiment.

In describing the preferred and selected alternate embodiments of the present invention, as illustrated in FIGS. 1A-9, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 6A-9, in the preferred embodiment, collecting apparatus 100 comprises seat 110, container frame 120, right leg 160, left leg 170 and bungees 200, wherein container frame 120 comprises interior 240, hinges 210 and clips 220. Seat 110 comprises seat front 130, hinges 115, seat opening 140 and notches 150, wherein hinges 115 permit front 130 of seat 110 to be raised to facilitate access to interior 240 of container 120 to retrieve objects 99 (best shown in FIG. 6B).

By reference to FIGS. 1A-9, bungees 200 comprise elastic members 16 and container frame 120 comprises frame 4 having lower portion 7 and upper portion 10 (best shown in FIG. 1A) as is more fully described hereinbelow. Right leg 160 comprises right base 180 and right handle 165, and left leg 170 comprises left base 190 and left handle 175. Legs 160, 170 are secured to container frame 120 via hinges 210. When right leg 160 and/or left leg 170 are fully downward or fully upward, right leg 160 and/or left leg 170 are secured to container from 120 via clips 220. When right leg 160 and/or left leg 170 are fully upward, legs 160, 170 are received in notches 150 of seat 110.

Figure 6A:
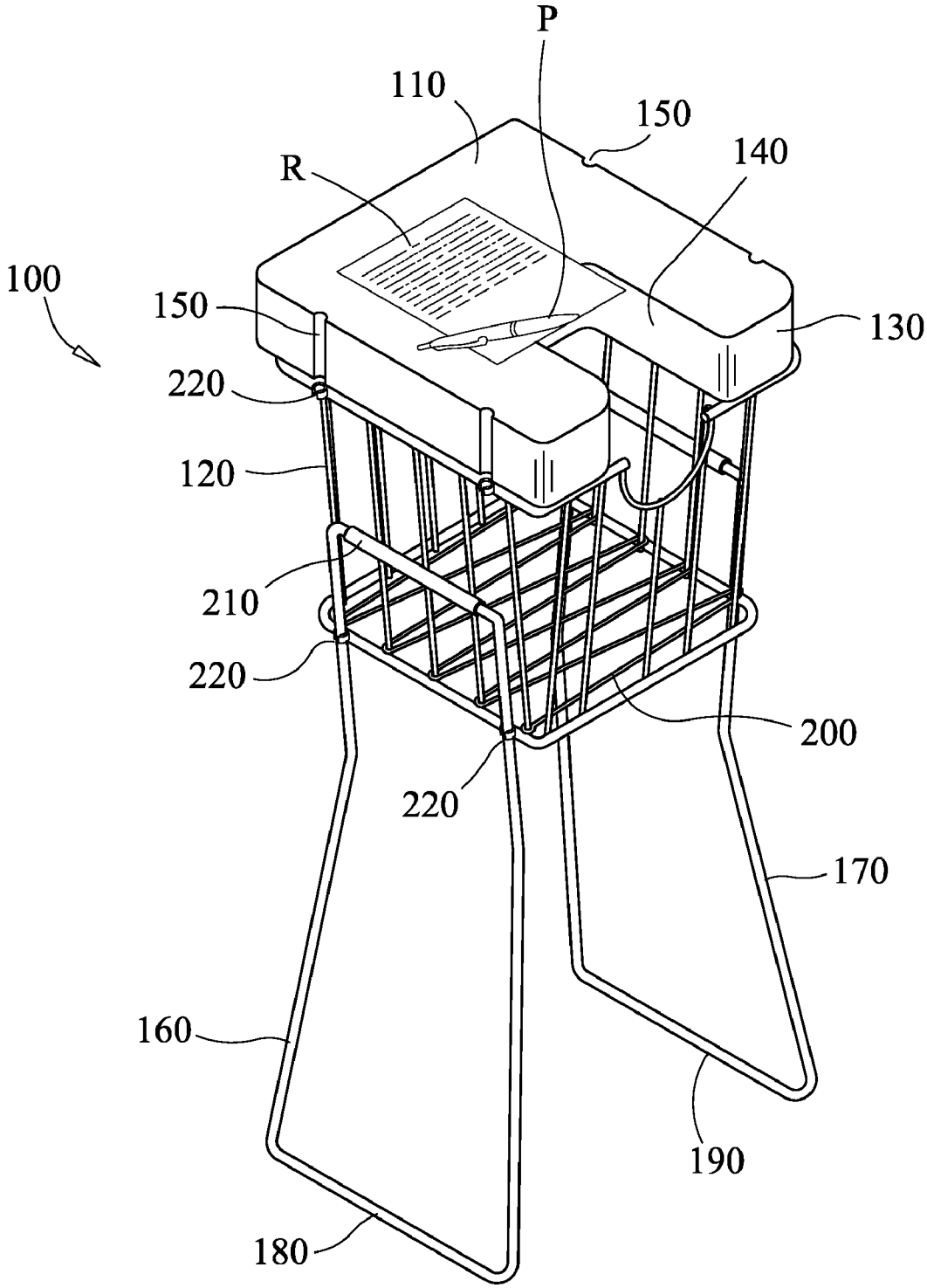
FIG. 6A depicts a perspective view of the preferred embodiment in standing position with seat down in place.
Figure 6B:
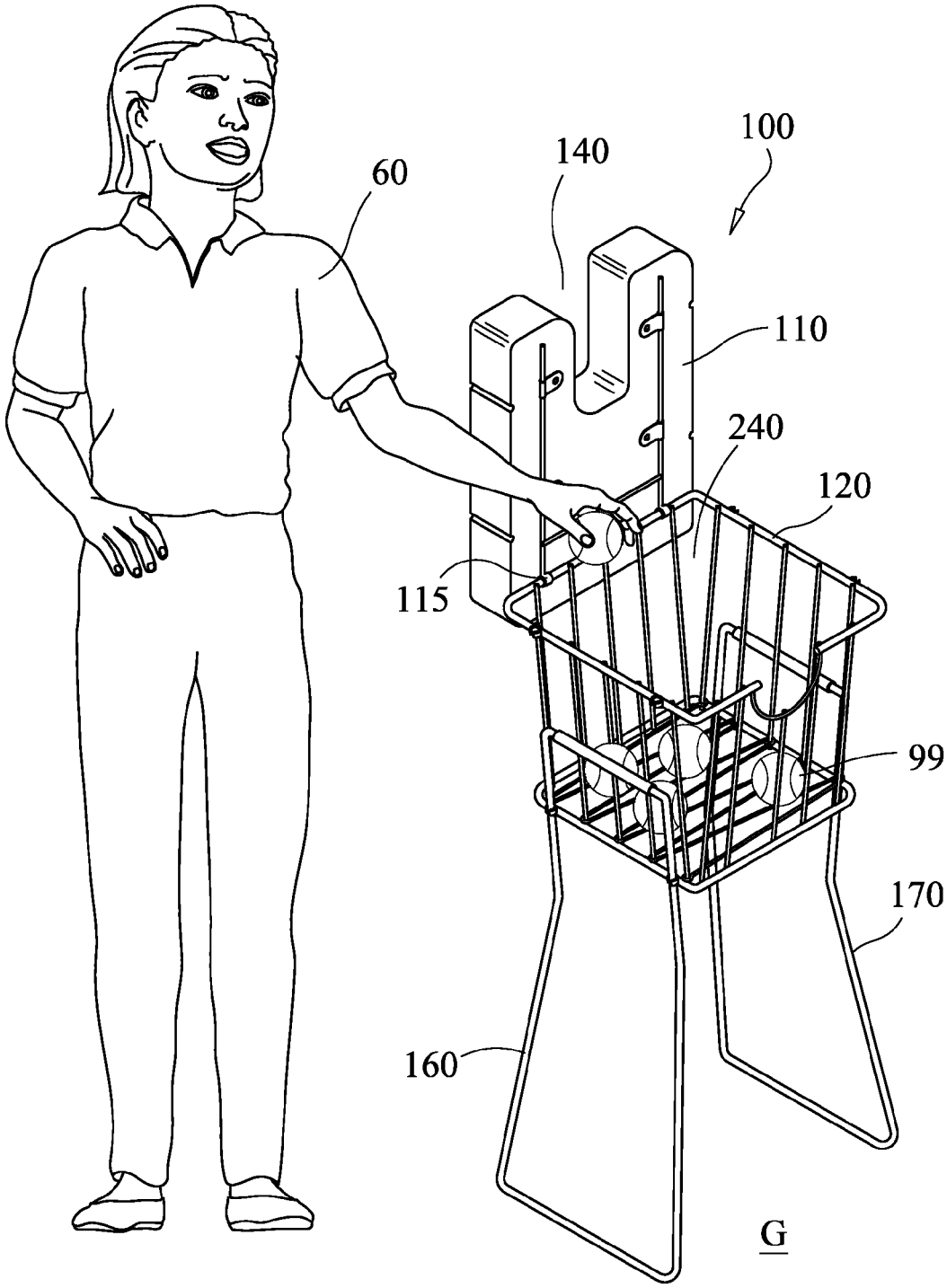
FIG. 6B shows a perspective view of the preferred embodiment in standing position, shown with seat up and user retrieving objects.
Figure 7:
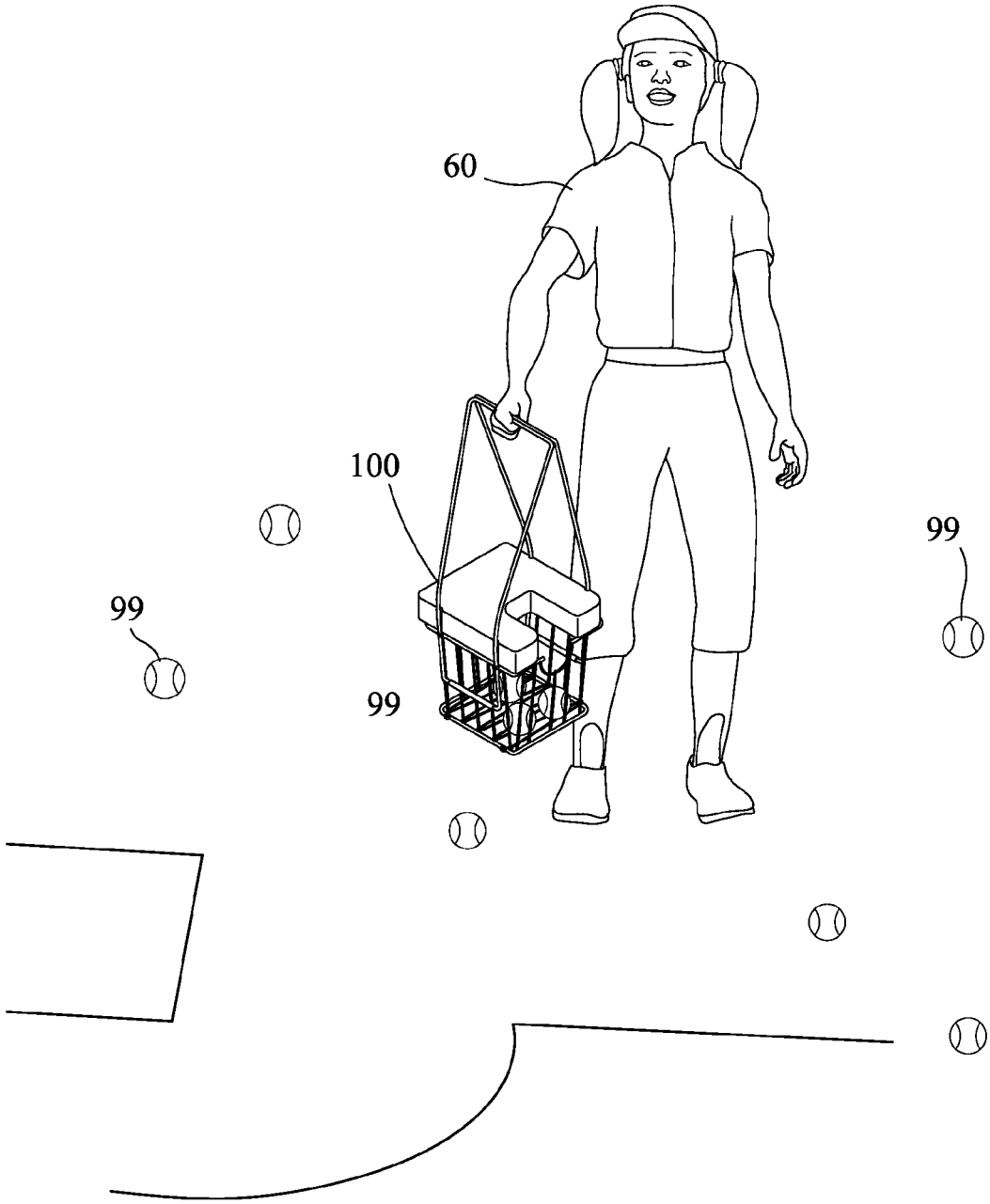
FIG. 7 depicts a perspective view of the preferred embodiment, shown with legs up to form a handle for transporting.

In use, the preferred embodiment of collecting apparatus 100 can selectively be stood upright on ground G, wherein legs 160, 170 are disposed fully downward and retained via lower set of clips 220 (best shown in FIG. 6B). User 60 retrieves objects by reaching to interior 240 through seat opening 140 and front opening 230, which together cooperatively form an opening dimensioned to permit extraction of objects 99 within container 120. Alternately, user 60 lifts seat 110 (best shown in FIG. 6B) to provide easier access to interior 240 of container frame 120.

Score card R and/or pen P, or similar objects can be placed on seat 110, when collecting apparatus 100 is in a standing position on legs 160, 170 as depicted in FIG. 6A.

To collect and/or transport objects, legs 160, 170 are hinged upward wherein right handle 165 is proximate left handle 175 and legs are retained by upper set of clips 220. User 60 grasps collecting apparatus 100 by handles 165, 175 and places collecting apparatus 100 over object 99 (best shown in FIG. 7), pressing same down and forcing object 99 through bungees 200 and into interior 240 of container frame 120. Once retrieved, objects 99 can be transported by user 60.

Figure 8A:
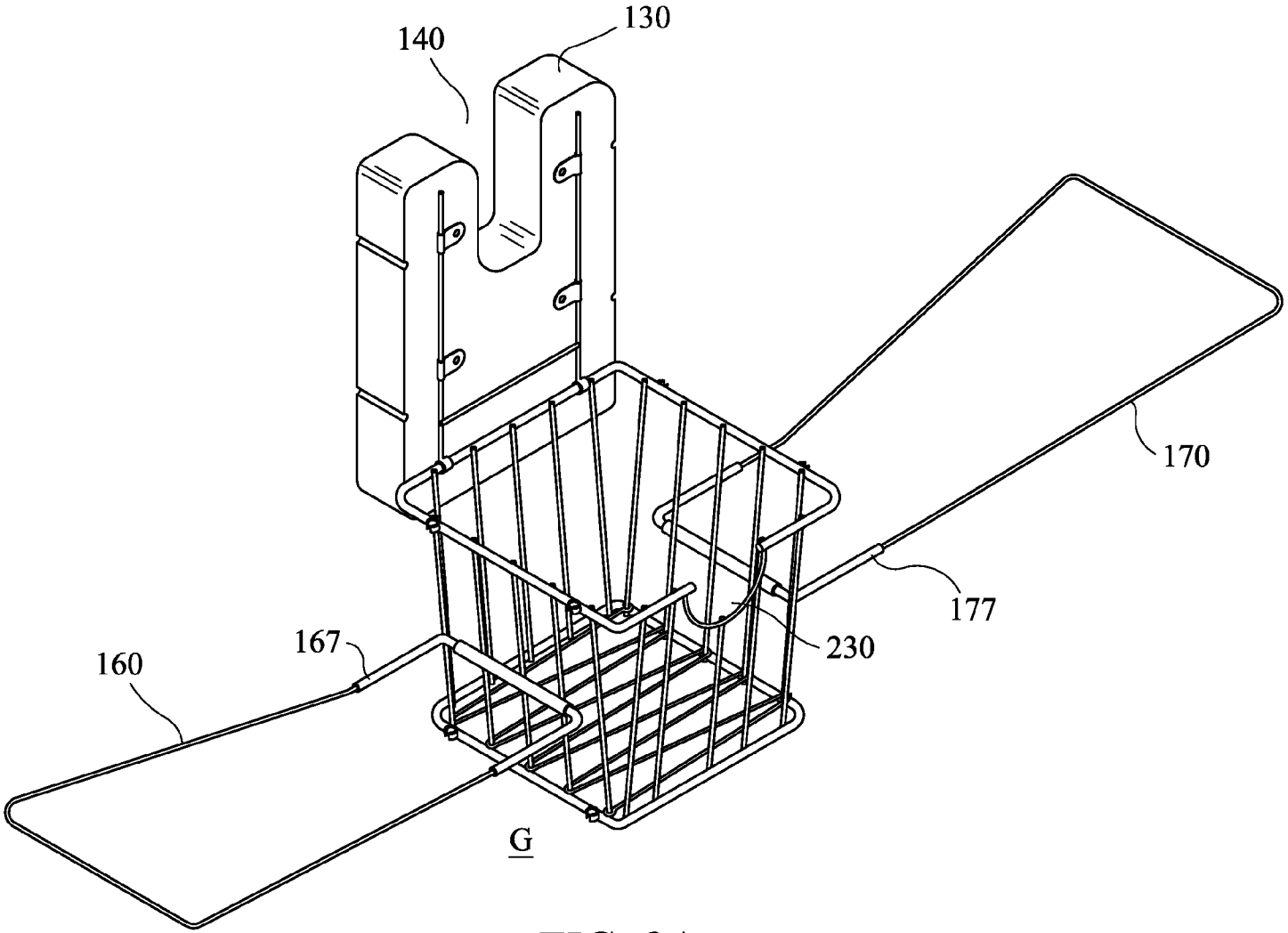
FIG. 8A shows a perspective view of the preferred embodiment, shown in place on the ground with seat up.
Figure 8B:
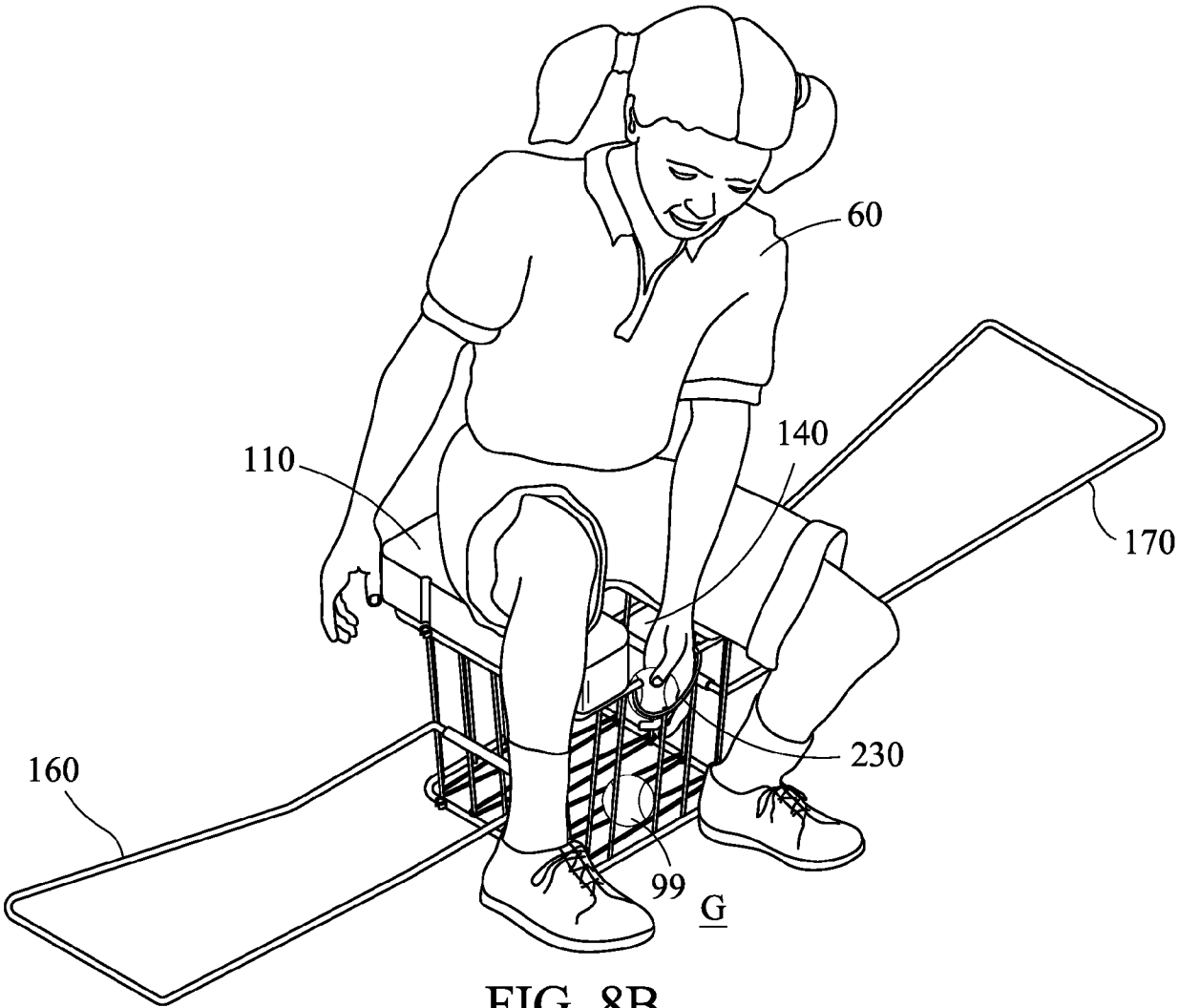
FIG. 8B depicts a perspective view of the preferred embodiment, shown with seated user retrieving an object from within a container portion.

When it is desired to utilize collecting apparatus as a sitting surface, legs 160, 170 are hinged sideways to a generally horizontal disposition and container frame 120 is placed on a surface, such as, for exemplary purposes only, ground G (best shown in FIG. 8B). User then sits on seat 110 and retrieves objects 99 from within container frame 120 by reaching into container frame 120 through seat opening 140 and front opening 230. Alternately, seat 110 can be lifted to provide ready access to interior 240 of container frame 120 (best shown in FIG. 8A). Legs 160, 170 provide stability to collecting apparatus 100 when positioned sideways as best shown in FIGS. 8A-8B. When desired, legs 160, 170 can be shortened by telescoping within telescopic sections 167, 177.

Figure 9:
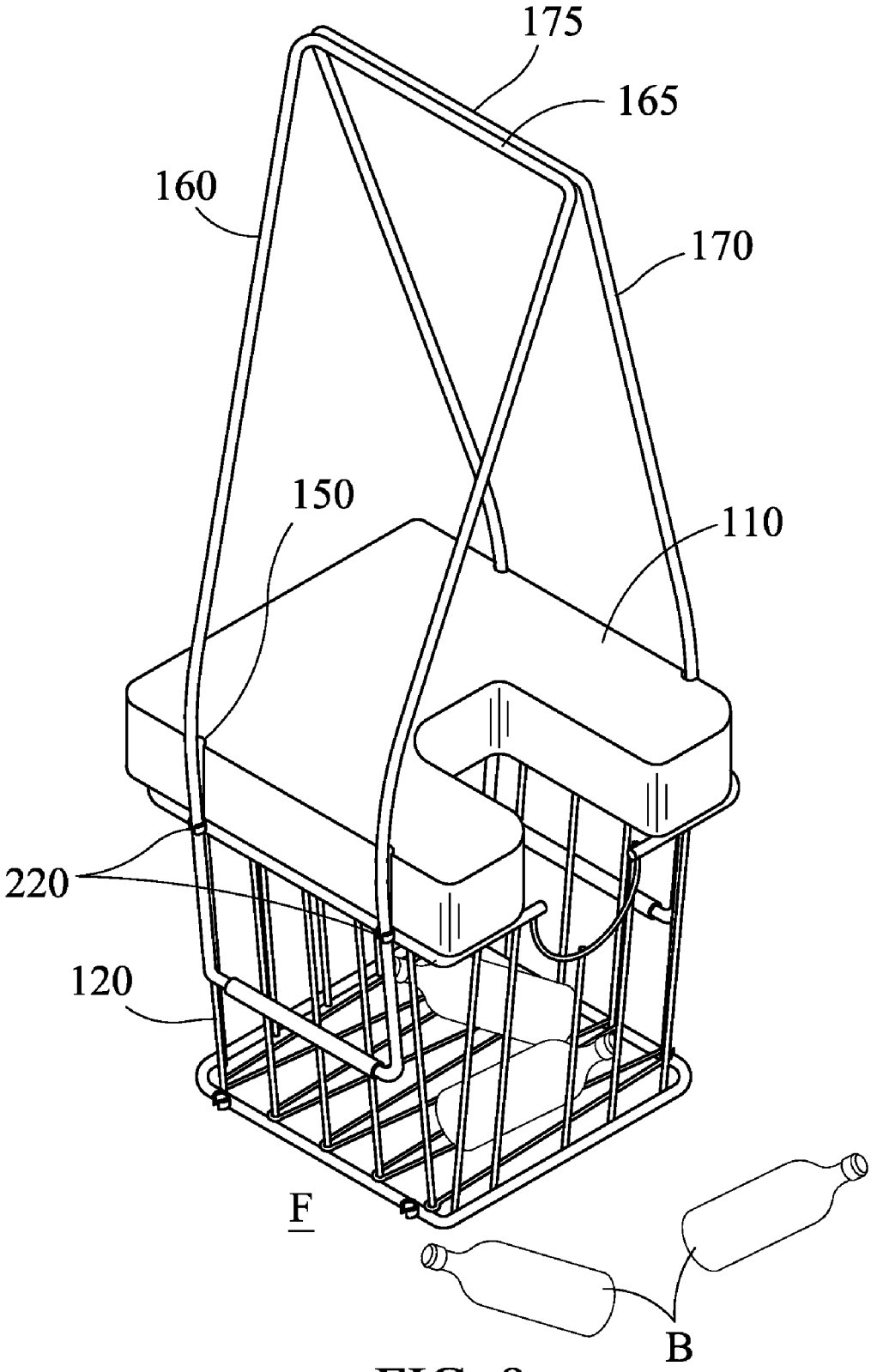
FIG. 9 shows a perspective view of the preferred embodiment, shown retrieving objects from a factory floor.

Collecting apparatus 100 can also be utilized to collect a variety of manufacturing objects, such as, for exemplary purposes only, electric motors (not shown) or bottles B from factory floor F (best shown in FIG. 9).

In an alternate embodiment, right leg 160 and left leg 170 could be telescopically secured to hinges 210 via right telescopic section 167 and left telescopic section 177, as such are known in the art for lengthening or shortening a tubular object.

Figure 1B:
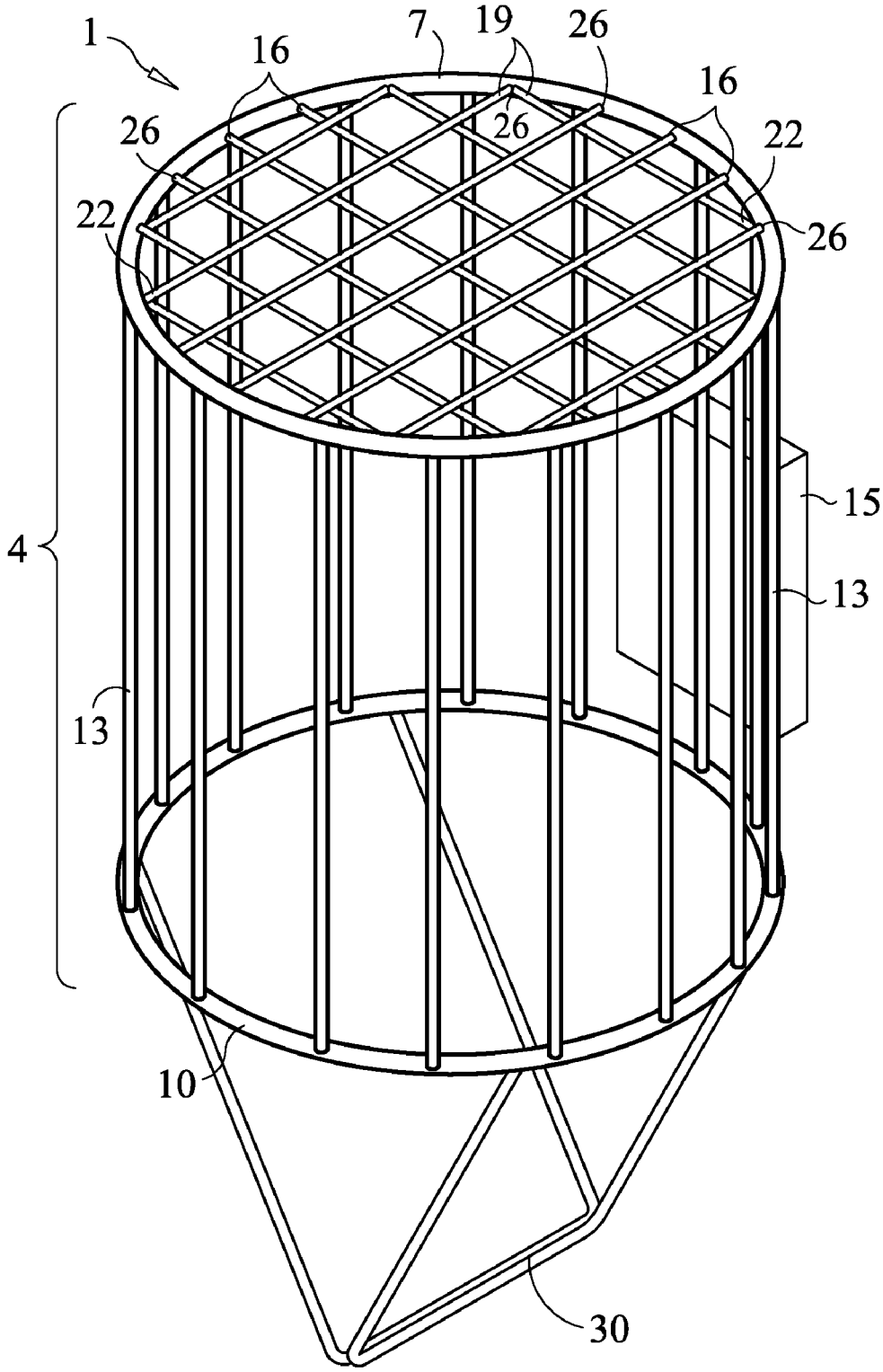
FIG. 1B shows a bottom perspective view an alternately shaped embodiment.

Referring now to FIGS. 1A and 1B, the present invention in preferred and alternate embodiments is collecting apparatus 1, wherein collecting apparatus 1 comprises frame 4, wherein frame 4 further comprises lower portion 7, upper portion 10 and plurality of connectors 13 joining lower portion 7 to upper portion 10 of frame 4 of collecting apparatus 1. Collecting apparatus 1 further comprises plurality of elastic members 16, wherein plurality of elastic 16 further comprises first ends 19 and second ends 22, wherein first ends 19 and second ends 22 are securable to selectable points 26 on lower portion 7 of frame 4. Collecting apparatus 1 also comprises at least one handle 30 which is secured to upper portion 10 of frame 4, although one skilled in the art would recognized handle 30 could be secured to any portion of collecting apparatus 1. Additionally, collecting apparatus 1 comprises pocket 15 for storing elastic members 16 when not in use. FIG. 1A depicts frame 4 of collecting apparatus 1 as substantially square, while FIG. 1B shows frame 4 of collecting apparatus 1 as substantially circular. It would be obvious to one skilled in the art to utilize other shapes to form frame 4 including, without limitation, ovals, rectangles, triangles, trapezoids, other shapes and/or any combination thereof.

Referring now more specifically to FIG. 1A, collecting apparatus 1 further comprises base portion 33, wherein base portion 33 comprises selectable point 26 for securing plurality of elastic member 16. Base portion 33 is removably secured to lower portion 7 of frame 4 via any known fastener, such as, for exemplary purposes only, by plurality of pegs 44. First ends 19 and second ends 22 of plurality of elastic members 16 are secured to plurality of pegs 44 disposed on base portion 33. Lower portion 7 of frame 4 has plurality of apertures 35 (best shown in FIG. 3B) of sufficient size to securely receive plurality of pegs 44 disposed on base portion 33. Thus plurality of elastic members 16 are disposed and secured between base portion 33 and lower portion 7 of frame 4. It would be obvious to one skilled in the art to utilize other shapes to form base portion 33, without limitation, ovals, rectangles, triangles, trapezoids, other shapes and/or any combination thereof.

Figure 2B:
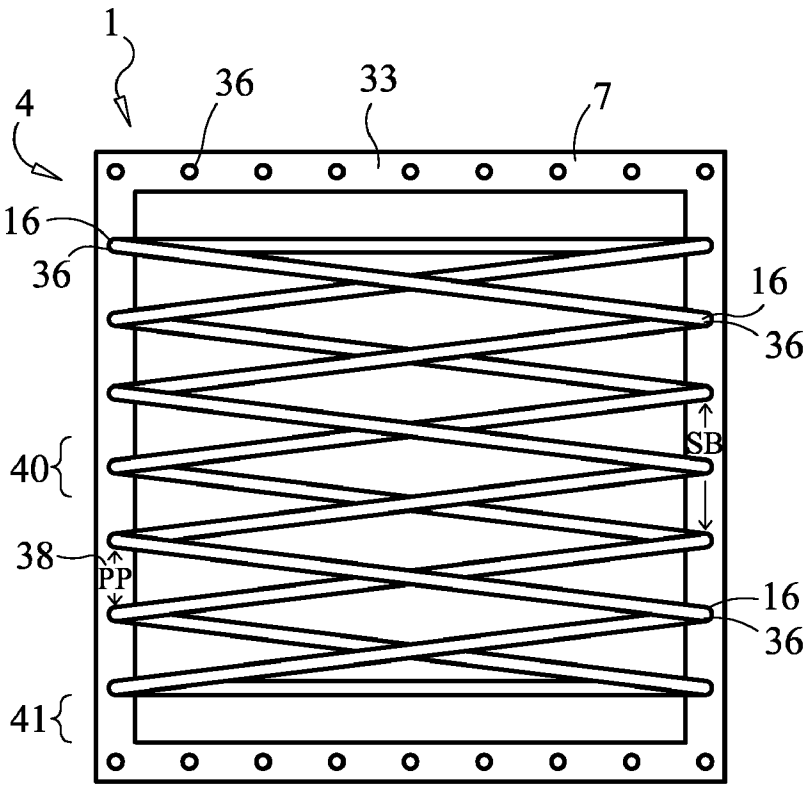
FIG. 2B shows a top sectional view of an alternate embodiment of the lower portion of the frame.
Figure 2A:
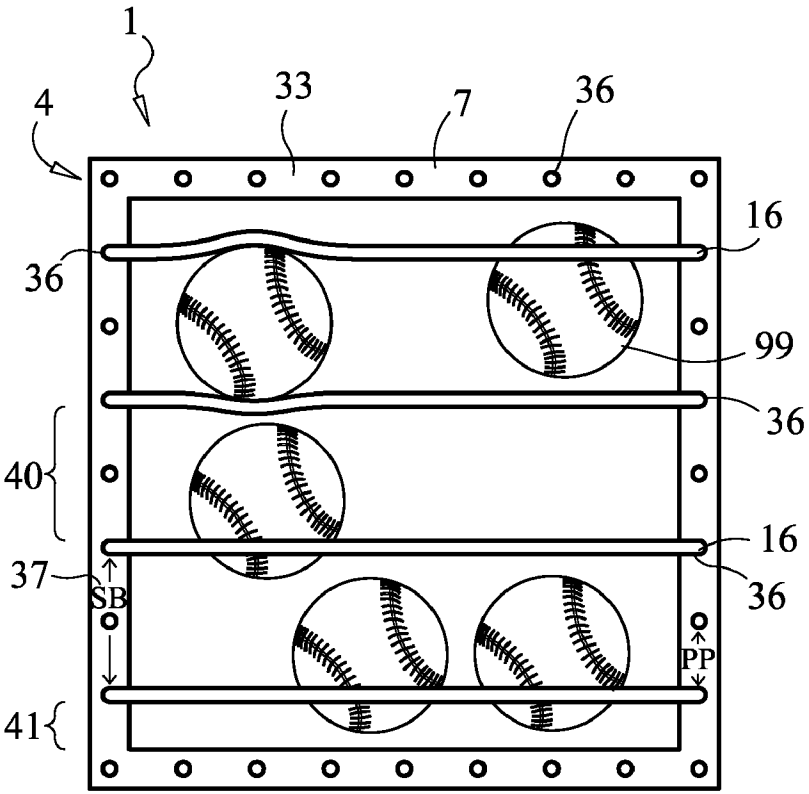
FIG. 2A shows a top sectional view of an alternate embodiment of the lower portion of the frame.

Referring now to FIGS. 2A and 2B, base portion 33 and/or lower portion 7 of frame 4 of collecting apparatus 1, are shown in an alternate embodiment, wherein plurality of elastic members 16 are shown secured to selected securing mechanisms 36. Collecting apparatus 1 also comprises indicia 37, 38 to indicate positioning of elastic members 16 on securing mechanisms 36 for objects of a certain size. Whereas when collecting apparatus 1 is utilized to collect sporting balls, for example, without limitation, elastic member distance 40 between plurality of elastic members 16 is appropriate for softballs 99 in FIG. 2A, as indicated by SB indicia 37, the arrangement of plurality of elastic members 16 in FIG. 2A, would be more appropriate to accommodate a smaller ball, such as ping pong balls, as indicated by PP indicia 38. Frame distance 41 may also be adjusted to accommodate different size objects. One skilled in the art would recognize different placement of securing mechanisms 36 and thus different placement of plurality of elastic members 16 is possible, although securing mechanisms 36 are spaced to most efficiently accommodate more common types of spherical objects of set shape. Additionally, plurality of elastic member 16 may run horizontally, vertically, diagonally and/or any combination thereof.

Referring now more particularly to FIGS. 3A-3D, alternate embodiments of base portion 33 and/or lower portion 7, are shown. In the alternate embodiment shown in FIG. 3A, securing mechanism 36 comprises plurality of apertures 42. Plurality of elastic members 16 (best shown in FIGS. 1A-2B) utilizes hooks 22 or other means to secure plurality of elastic members 16 to plurality of apertures 42 disposed on base portion 33 and/or lower portion 7.

Figure 3B:
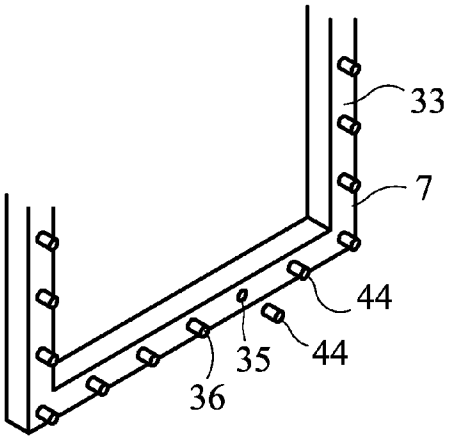
FIG. 3B shows a partial perspective view of an alternate embodiment of the lower portion of the frame showing pegs.

In the embodiment shown in FIG. 3B, securing mechanism 36 comprises plurality of pegs 44. Plurality of elastic members 16 (best shown in FIGS. 1A-2B) utilizes hooks 22 (best shown in FIG. 1A), loops 27 (best shown in FIG. 5A) and/or other means to secure plurality of elastic members 16 to plurality of pegs 44 disposed on base portion 33 and/or lower portion 7.

Figure 3D:
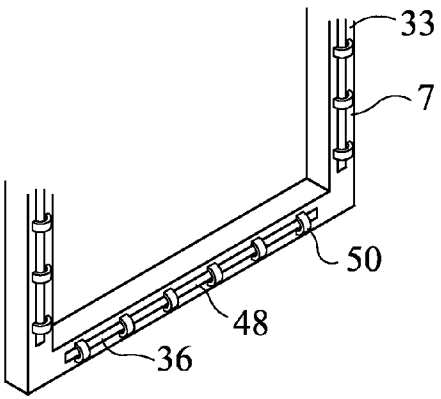
FIG. 3D shows a partial perspective view of an alternate embodiment of the lower portion of the frame showing track and sliding members.
Figure 3A:
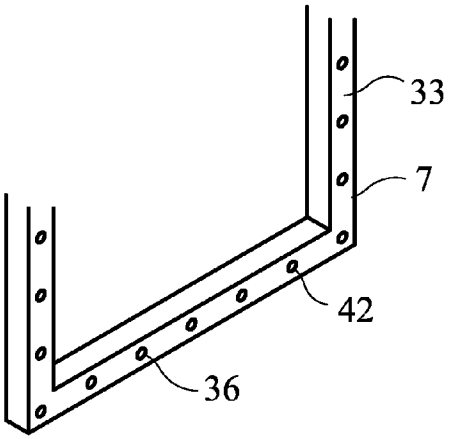
FIG. 3A shows a partial perspective view of an alternate embodiment of the lower portion of the frame showing apertures.
Figure 3C:
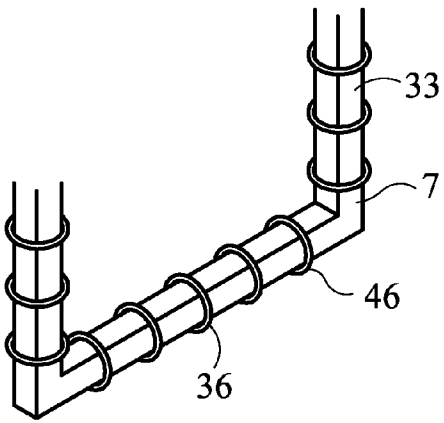
FIG. 3C shows a partial perspective view of an alternate embodiment of the lower portion of the frame showing rings.

Referring now to FIG. 3C, illustrated therein is an alternate embodiment, wherein securing mechanism 36 is plurality of rings 46 movably secured to base 33 and/or lower portion 7. Plurality of elastic members 16 utilizes hooks, loops (not shown) and/or other means to secure plurality of elastic members 16 to plurality of rings 46 on base portion 33 and/or lower portion 7.

Referring now to FIG. 3D, illustrated therein is an alternate embodiment, wherein securing mechanism 36 comprises track 48 and adjustable members 50, and wherein adjustable members 50 are movably secured to track 48, and wherein track 48 is secured to base 33 and/or lower portion 7. Plurality of elastic members 16 utilizes hooks, loops (not shown) and/or other means to secure plurality of elastic members 16 to adjustable members 50 on track 48, wherein track 48 is disposed on base portion 33 and/or lower portion 7.

Figure 4:
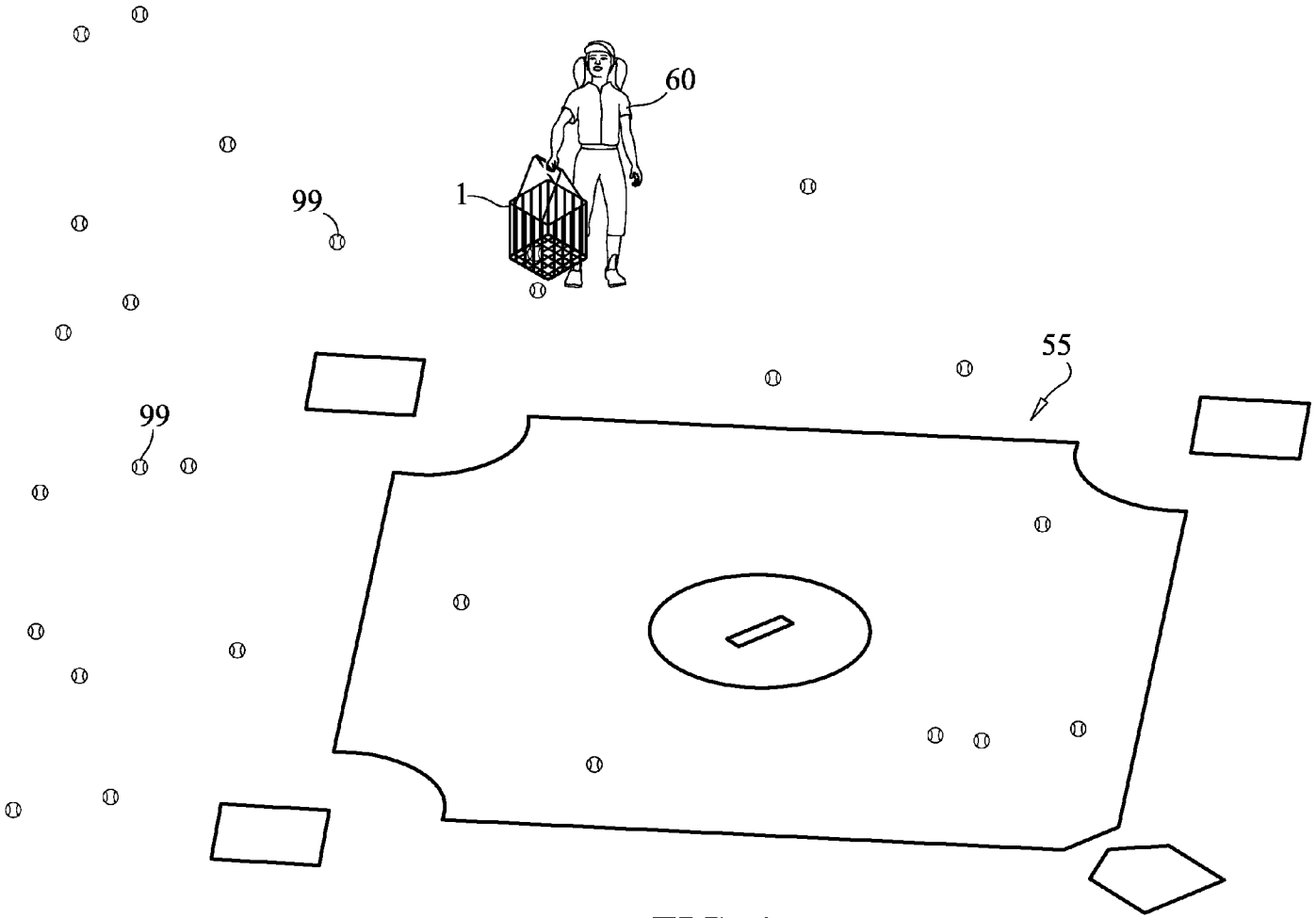
FIG. 4 shows a perspective view of an alternate embodiment of the collecting apparatus in use on a softball field.

Referring now specifically to FIG. 4, user 60 is shown on playing field 55 utilizing ball collecting apparatus 1 to remove softballs 99 from playing field 55, wherein user 60 places ball collecting apparatus 1 over balls 99 and presses down, and wherein ball 99 moves through plurality of elastic members 16 within ball collecting apparatus 1, whereby balls 99 are contained for transport and/or storage.

In use, as best shown in FIG. 2A, at least one elastic member 16 is secured to lower portion 7 of frame 4 or base portion 33. At least one elastic member 16 is secured to lower portion 7 of frame 4 or base portion 33 via securing mechanism 36. Elastic member distance 40 between plurality of elastic members 16, and frame distance 41 between plurality of elastic members 16 and base portion 33 or lower portion 7 of frame 4 is adjustable to selectively create elastic member distance 40 and/or frame distance 41, wherein elastic member distance 40 and/or frame distance 41 is slightly smaller than the diameter of object 99. Once downward force is applied to ball collecting apparatus 1 while over object 99, plurality of elastic members 16 expand to slightly larger than the diameter of object 99, thus allowing object 99 to enter frame 4 where object 99 is stored until use. Object 99 is prevented from falling out of frame 4 via plurality of elastic members 16, wherein plurality of elastic members 16 contract to their original position.

Figure 5A:
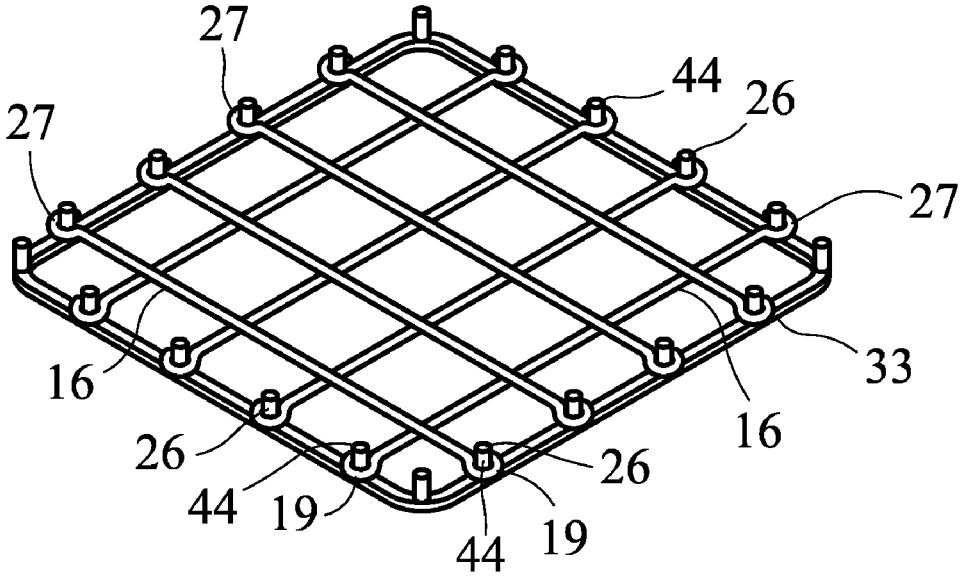
FIG. 5A is a perspective view of a bottom frame of a collecting apparatus showing hook ends of elastic members according to an alternate embodiment.
Figure 5B:
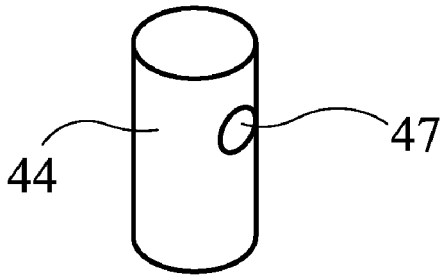
FIG. 5B is a side view of a peg with aperture according to an alternate embodiment.
Figure 5C:
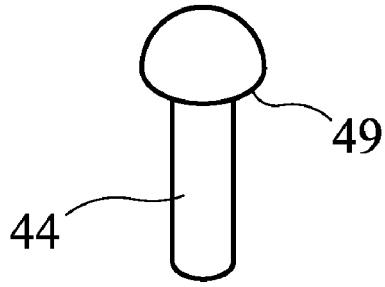
FIG. 5C is a side view of a peg with flange according to an alternate embodiment.

In an additional alternate embodiment shown in FIG. 5C, plurality of pegs 44 has a lower portion secured to the lower portion of the frame and an upper portion, wherein the upper portion has securing flange 49, for exemplary purposes only, and not intended to be limiting, pegs 44 with securing flange 49 in the shape of an arrow facing up in relation to the lower portion of the frame, a T-shape, mushroom shape, similar shape and/or any combination of the like.

In a further alternate embodiment shown in FIG. 5B, plurality of pegs 44 has aperture 47 for securing the plurality of elastic members 16.

In a further alternate embodiment, plurality of pegs 44 are removably secured to lower portion 7 of the frame via apertures 35 (best shown in FIG. 3B).

The foregoing description and drawings comprise illustrative embodiments of the present invention. Having thus described exemplary embodiments of the present invention, it should be noted by those skilled in the art that the embodiments within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A collecting apparatus comprising:

a containment frame, wherein said containment frame comprises an opening in a front portion thereof;

elastic members disposed at a bottom portion of said containment frame, wherein objects collected by said collecting apparatus pass through said elastic members into an interior portion of said containment frame; and a seat, wherein said seat comprises an opening in a front portion thereof, and wherein said seat opening and said containment frame opening cooperatively form an aperture for access to said interior portion of said containment frame.

2. The collecting apparatus of claim 1, wherein said seat is hingedly secured to said containment frame.

3. The collecting apparatus of claim 1, wherein said elastic members are selectively secured to points disposed on said bottom portion of said containment frame.

4. The collecting apparatus of claim 3, wherein said points disposed on said bottom portion of said containment frame are identified by markings which correspond to a particular size object.

5. The apparatus of claim 4, wherein said elastic members are adjustable in length.

6. The apparatus of claim 5, wherein said elastic members comprise first ends and second ends with fasteners at said first ends and said second ends, and wherein said bottom portion of said containment frame comprises fasteners, and wherein said frame fasteners cooperatively engage said elastic member fasteners.

7. The apparatus of claim 1, further comprising at least two supporting legs.

8. The apparatus of claim 7, wherein said at least two legs hinge downward to form a stand for said collecting apparatus.

9. The apparatus of claim 7, wherein said at least two legs hinge upward to form a handle to transport said collecting apparatus.

10. The apparatus of claim 7, wherein said at least two legs are telescopic.

11. The apparatus of claim 7, wherein said containment frame comprises clips dimensioned to receive and secure said at least two legs.

12. A collecting apparatus comprising:

a containment frame;

elastic members disposed at a bottom portion of said containment frame, wherein objects collected by said collection apparatus pass through said elastic members into an interior portion of said containment frame;

at least two supporting legs;

a seat, wherein said seat comprises notches dimensioned to receive said at least two supporting legs.

13. A method of collecting objects, wherein said method comprises the steps of:

obtaining a collecting apparatus having a seat, legs and a containment frame, wherein said seat comprises a seat opening at the front thereof, and wherein said containment frame comprises a front opening, and wherein said seat opening and said front opening cooperatively form an aperture into an interior portion of said containment frame;

securing at least one elastic member to a lower portion of said containment frame in an original position, wherein said original position creates a space between each of said at least one elastic member and said containment frame, and wherein said space is smaller than a diameter of an object to be picked up;

pressing said containment frame over one of the objects, wherein said pressing causes forces to be exerted on said at least one elastic member, and wherein said at least one elastic member moves said space open to a width which allows the object to enter said containment frame;

said at least one elastic member returning substantially back to said original position;

hinging said legs to a generally horizontal disposition;

placing said containment frame on a surface;

sitting on said seat;

reaching through said aperture; and retrieving collected objects from said containment frame.

14. The method of claim 13, wherein said collecting apparatus further comprises legs, said method further comprising the steps of:

hinging said legs downward to support said collecting apparatus;

standing said collecting apparatus on a surface; and retrieving collected objects from said containment frame.

* * * * *